United States Patent [19]

Oddo

[11] 4,185,267

[45] Jan. 22, 1980

[54] DETECTING WATER ON BOAT EXHAUST MANIFOLD

[76] Inventor: Luigi G. Oddo, Rte. 2, Box 270, Palm Bay, Fla. 32905

[21] Appl. No.: 898,475

[22] Filed: May 17, 1978

[51] Int. Cl.[2] ..... G08B 21/00

[52] U.S. Cl. ..... 340/59; 340/605; 340/620

[58] Field of Search ..... 340/59, 603, 605, 618, 340/620

[56] References Cited

U.S. PATENT DOCUMENTS

| | | | |
|---|---|---|---|
| 3,333,258 | 8/1967 | Walker et al. | 340/620 |
| 3,763,836 | 10/1973 | Guehr | 340/59 |
| 3,845,464 | 10/1974 | Engel | 340/59 |
| 4,110,739 | 8/1978 | Kidd | 340/605 |

*Primary Examiner*—Alvin H. Waring

[57] ABSTRACT

A device for sensing the presence of water within the exhaust manifold of a marine engine. A probe is provided having a first conductive element and a second conductive element operably extending into the main exhaust gas chamber within the exhaust manifold. Circuit means are provided having an input operably coupled to the probe for sensing and displaying a reduction in the effective impedance between the first and second conductive elements responsive to water being operably coupled therebetween.

9 Claims, 1 Drawing Figure

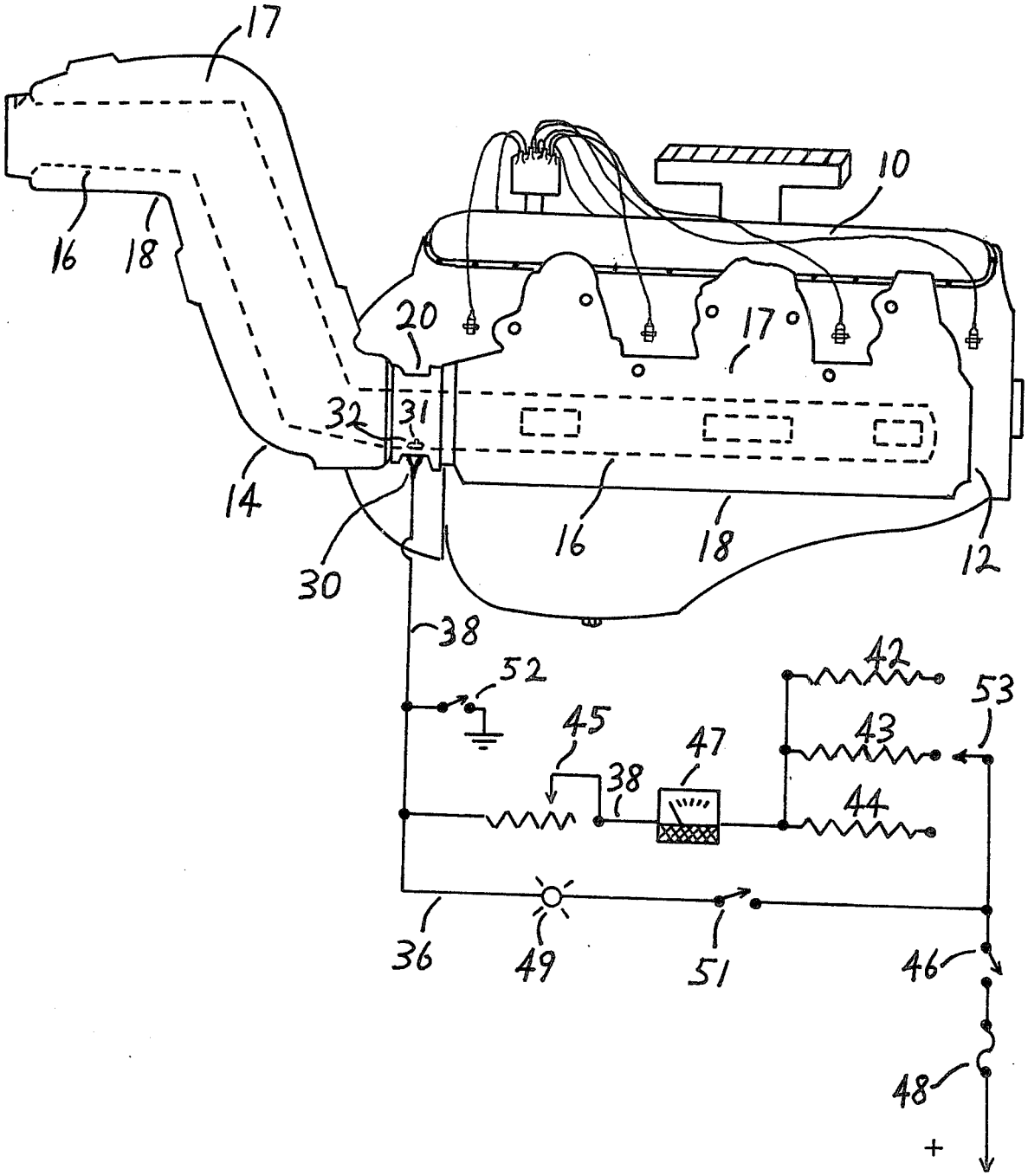
17
10
16
18
20
17
32
31
14
30
16
18
12
38
52
42
53
45
43
47
38
44
36
49
51
46
48
+

DETECTING WATER ON BOAT EXHAUST MANIFOLD

BACKGROUND OF THE INVENTION

1. FIELD OF THE INVENTION

The present invention relates to marine engines, and more precisely to a system for sensing the presence of water within the exhaust manifold of a marine engine.

2. DESCRIPTION OF THE PRIOR ART

When marine engines are operated in a saltwater environment, the abrupt deceleration of the boat can allow salt water to enter through the exhause riser of the exhaust manifold system. This salt water may collect in the lower portions of the exhaust manifold system and thereby causing oxidation and rusting of the parts therein. This premature oxidation of the metal parts in the exhaust system can also be caused from water which is circulated through the exhaust riser system leaking through a gasket or other fault within the manifold and collecting within a lower section of the exhaust manifold. There are presently no systems or devices which are manufactured or marketed for sensing the presence of water within the exhaust manifold so as to provide sufficient lead-time in order for the owner of the marine engine to correct the defect or to remove the water from the exhaust manifold.

The primary object of the present invention is to provide a sensor which may be coupled through the exhaust manifold for actively and continuously sensing for the presence of water therein. When the presence of water is detected within the exhaust manifold, the operator may immediately take preventative action such as maintenance, repairs, etc.

SUMMARY OF THE INVENTION

The present invention relates to a device for sensing the presence of water within the exhaust manifold of a marine engine. Probe means are provided for being removably coupled through a single-walled section of the engine exhaust manifold. The probe means includes a first conductive element and a second conductive element insulated therefrom. Both the first and second conductive elements are operably extended into the main exhaust gas chamber within the exhaust manifold, whereby water within the exhaust manifold will provide a lower impedance path between the first and second conductive elements. Circuit means are provided having an input operably coupled to the probe means for sensing and displaying a reduction in the effective impedance between the first and second conductive elements.

BRIEF DESCRIPTION OF THE DRAWINGS

Other objects, features and advantages of the present invention will be apparent from a study of the written description and the drawings in which:

FIG. 1 illustrates a simplified block and schematic diagram of the device for sensing the presence of water as the device is coupled to the exhaust manifold of a marine engine.

DETAILED DESCRIPTION OF THE PREFERRED EMBODIMENT

The present invention includes a transmitting element or probe, shown generally as 30, which comprises a device similar in construction (but not physically identical to) a nonresistor auto spark plug. The probe 30 may be constructed of a conductive metal element such as stainless steel with an interior insulating element which separates a first or center conductive element 31 from a second or ring-shaped conductive element 32. Both the first conductive element 31 and the second conductive element 32 communicate through a single-walled section of a coupler section 20 which is operably interposed between the main exhaust manifold 12 of a marine engine 10 and the riser section 14 of the exhaust manifold.

It will be apparent to one skilled in this art that the typical construction of a marine engine exhaust manifold system includes an inner wall 16 and an external wall 18 which define therebetween a chamber 17 which contains circulating water for cooling the exhaust system of the marine engine. Typically in the coupler 20 there exists a small area in which the external wall 18 and the internal wall 16 converge to form a single wall without any space for the flow of cooling water therebetween. It is precisely at this point where the probe 30 is located in the first preferred embodiment of the present invention. It will be noted from FIG. 1 that this location for the probe 30 is typically one of the lowest sections within the internal wall of the engine exhaust system, such that when any water is present within the system it will typically either pass or collect adjacent to the probe 30.

The primary function of the probe 30 is to detect any variation of the impedance between the first conductive element 31 and the second conductive element 32 caused by condensation or water being located therebetween. This change in the resistance between the two conductive elements is reflected as a variation of the reading indicated upon a milliammeter 47 which is located within a circuit line 38 (typically a single conductor wire) which is in turn coupled to the first conductor element 31 of the probe 30. As will be explained subsequently, the visual indication on the meter 47 will be in direct proportion to the amount of moisture or water communicating with the probe 30. Generally, when the engine is cold there is some sporadic indication which represents minimal condensation on the probe 30. However, as soon as the engine attains normal operating temperatures, the reading of the ammeter 47 should reduce to a minimum level representing the absence of moisture within the exhaust manifold. When either fresh water or salt water leaks from the connecting joints of the exhaust manifold and the riser or from the leaks through the riser or manifold, then the ammeter 47 will indicate a relatively low impedance as compared to its open circuit state. Typically, the ammeter 47 will indicate nearly a fullscale reading to indicate to the operator that moisture or water is present ($\frac{1}{2}$ ma maximum current).

A verification system is provided by coupling an incandescent lamp 49 in series with a circuit conductor 36 which is coupled in parallel with the meter 47. This verification system may be actuated by closing a series switch 51 and the circuit conductor 36 which will allow the incandescent lamp 49 to conduct if there is a relatively low impedance between the first conductive element 31 and the second conductive element 32 comprising the probe 30. Verification may also be made by removing the probe 30 and making a visual identification of the water inside the exhaust manifold system.

A separate shorting switch 52 is provided between the circuit conductor 38 and ground, which is generally in parallel with the probe 30. In this manner the remainder of the circuit may be adjusted by closing the shorting switch 52 so as to indicate the presence of moisture on the probe 30.

An adjustment potentiometer 45 (40 kohm) is provided in series with the meter 47 to limit the series current therethrough.

Three separate fixed value resistors are interchangeably coupled in series with the circuit conductor 38 by operation of the selector switch 53. When this device is used in a 6-volt system the selector switch 53 is coupled to a first resistor 42 which is a ½ watt 14 kilo-ohm resistance. When the device is used in a 12-volt system the selector switch 53 is coupled to a second fixed resistance 43 which is a ½ watt 22 kilo-ohm resistor. When the device is coupled in a 24-volt system the selector switch 53 is coupled to a third resistance 44 which comprises a ½ watt 30 kilo-ohm resistance.

The output of the selector switch 53 is coupled through a fuse 48 and an on-off switch 46 to the positive terminal of the battery normally used in the boat.

The electrical components described above may be assembled in a metal enclosure which may be mounted on or near the instrument panel of the boat. The metal enclosure may include a removable cover for quick access for adjustments and repairs. When changing the device from a boat having a different voltage system it may also be necessary to change the value of the incandescent lamp 49 to provide satisfactory illumination during testing. The device may also be converted for use with a positive ground system by reversing the wires on the ammeter 47.

The present device may be easily connected to the electrical system of an existing boat since typically only a single wire connection 38 is required in order to couple the probe 30 to the electronic sensing system, especially since the return path of the sensing electronics is obtained from the second conductive element 32 of the probe 30, through the coupler 20, then through the exhaust manifold 12, through the marine engine to a grounding post which is typically coupled to the negative terminal of the battery. However, it is envisioned to be within the scope of this invention to utilize a dual line system for the circuit conductor 38 so that any resistance sections within the manifold and engine ground return loop may be eliminated.

As illustrated in FIG. 1, the probe 30 is similar in appearance to the typical automobile spark plug in that a first conductive element 31 is located generally in the center of a generally ring-shaped second conductive element 32. It is strongly recommended for the proper operation of the first preferred embodiment of the present invention that the first conductive element 31 extend upwardly into the main exhaust gas chamber defined within the internal wall 16 of the exhaust manifold 12. It may also improve the performance of the device if a similar upstanding appendage is coupled to the second conductive element 32 so that any moisture or water resting near the probe 30 will provide a relatively low impedance or low resistance connection between the first conductive element 31 and the second conductive element 32 of the probe 30. As previously discussed, the first conductive element 31 and the second conductive element 32 are separated from each other through an electrical insulator of the type utilized in automotive spark plugs. The probe 30 may be removed from the exhaust manifold coupler 20 in a manner similar to the process of removing a spark plug from an internal combustion engine.

The operation of the present device may be described as follows. The shorting switch 52 is first closed and the variable resistance potentiometer 45 is adjusted until the maximum reading on the ammeter 47 is obtained. Then, the shorting switch 52 is opened in order to have the electronic circuit connected directly to the probe 30. It is recommended that the series switch 51 for activating the incandescent lamp 49 be left in the open condition in order to maximize the sensitivity of the sensing meter 47. When confirmation of the presence of water within the exhaust manifold is required, the series switch 51 may be closed which will allow current to flow through the incandescent lamp 49, thereby confirming the presence of water within the exhaust manifold system.

In accordance with the provisions of the United States Patent Laws, the preferred embodiment of the present invention has been described in detail. The principles of the present invention have been described in the best mode in which it is now contemplated that such principles may be applied. However, it should be understood that the construction shown and described in the attached specification and the drawings are merely illustrative and the invention should not be limited thereto. Accordingly, alterations and modifications which readily suggest themselves without departing from the true spirit of the disclosure herein are intended to be included in the scope of the following claims.

I claim:

1. A device for sensing the presence of water within the exhaust system of the marine engine, said device comprising in combination:

probe means for being removably coupled through a section of the engine exhaust system, said probe means including a first conductive element and a second conductive element juxtaposed therewith but insulated therefrom, with both said first and second conductive elements operably extending into an exhaust gas chamber within the exhaust system, whereby water within the exhaust system will provide a lower impedance path between said first and second conductive elements; and circuit means having an input operably coupled to said probe means for sensing and displaying any reduction in the effective impedance between said first and said second conductive element.

2. The water sensing device for marine engine systems as described in claim 1 wherein said first conductive element comprises an appendage projecting vertically from said probe means and into the exhaust gas chamber.

3. The water sensing device for marine engine systems as described in claim 2 wherein said second conductive element includes a ring-shaped connector for being operatively coupled through the engine exhaust system with said first conductive element being retained generally within said ring connector.

4. The water sensing device for marine engine systems as described in claim 3 wherein said probe means is removeably coupled through a single-walled section of the engine exhaust system.

5. The water sensing device for marine engine systems as described in claim 4 wherein said single-walled section of the engine exhaust system comprises a coupler section interposed between the portion of the exhaust manifold adjacent the engine and the riser section of the engine exhaust system.

6. The water sensing device for marine engine systems as described in claim 2 wherein said probe means are located adjacent a lower section within the engine exhaust manifold so as to be in operative communication with any water therein.

7. The water sensing device for marine engine systems as described in claim 6 wherein said circuit means includes a meter for displaying the effective impedance sensed by said circuit means.

8. The water sensing device for marine engine systems as described in claim 7 wherein said circuit means includes a source of illumination for visually indicating the relative level of the effective impedance sensed by said circuit means.

9. The water sensing device for marine engine systems as described in claim 6 wherein said second conductive element is electrically coupled to the exhaust manifold, which in turn is electrically coupled back to another input of said circuit means, thereby completing the closed circuit through an already existing conductive path through the engine systems.

* * * * *